United States Patent [19]

Yamaguchi

[11] Patent Number: 4,920,235

[45] Date of Patent: Apr. 24, 1990

[54] CONDUCTIVE CABLE SHEATH

[75] Inventor: Akio Yamaguchi, Kasugai, Japan

[73] Assignee: Kitagawa Industries Co., Ltd., Aichi, Japan

[21] Appl. No.: 276,488

[22] Filed: Nov. 28, 1988

[30] Foreign Application Priority Data

Dec. 4, 1987 [JP] Japan ..... 62-185768[U]

[51] Int. Cl.[5] ..... H01B 7/34

[52] U.S. Cl. ..... 174/36; 24/442; 24/450; 174/DIG. 11; 138/167; 138/168

[58] Field of Search ..... 174/36, DIG. 11; 138/167, 168; 24/442, 450

[56] References Cited

U.S. PATENT DOCUMENTS

| | | | |
|---|---|---|---|
| 2,585,054 | 2/1952 | Stachura | 174/36 |
| 3,089,915 | 5/1963 | Plummer | 174/36 |
| 3,372,438 | 3/1968 | Rinecker | 24/450 X |
| 3,582,532 | 6/1971 | Plummer | 174/36 |
| 3,941,159 | 3/1976 | Toll | 138/147 |
| 4,281,211 | 7/1981 | Tatum et al. | 174/36 |
| 4,409,427 | 10/1983 | Plummer, III | 174/36 |
| 4,639,545 | 1/1987 | Pithouse et al. | 174/36 |
| 4,684,762 | 8/1987 | Gladfelter | 174/DIG. 11 X |
| 4,776,068 | 10/1988 | Smirlock et al. | 24/442 |
| 4,791,236 | 12/1988 | Klein et al. | 174/36 |
| 4,815,172 | 3/1989 | Ward | 24/442 X |

FOREIGN PATENT DOCUMENTS

| | | | |
|---|---|---|---|
| 2364004 | 5/1978 | France | 24/450 |
| 61-120118 | 7/1986 | Japan . | |
| 8603050A | 5/1986 | PCT Int'l Appl. . | |
| 878893 | 10/1961 | United Kingdom . | |

*Primary Examiner*—Morris H. Nimmo

*Attorney, Agent, or Firm*—Oliff & Berridge

[57] ABSTRACT

A conductive sheath for electrical cable including fasteners with hooks that hold together a conductive shield. This design accommodates all cables bundle diameters and is easily installed even after the cables have already been installed.

4 Claims, 8 Drawing Sheets

CONDUCTIVE CABLE SHEATH

BACKGROUND

1. Field

This device relates to a conductive sheath for electromagnetically shielding electric cable.

2. Prior art

Japan Published Unexamined Utility Model Application No. S61-120118 discloses a tube-shaped cable sheath made of a knitted wire mesh. Unfortunately, it comes in a fixed sizes, so different sizes must be used with cable bundles of different diameters. Also, because it is a tube, it cannot be installed after the cable bundle has been installed.

A prior-art cable sheath addressing these problems has been proposed. As shown in FIG. 14, a shielding strip 8 is spirally wound around a bundle of cables 4 and is held in place by cable ties 9. However, if the cable is bent, the closed surface of the sheath is likely to break between the cable ties 9. To prevent this, more cable ties 9 must be used at closer intervals. This makes installation more expensive and more tedious.

SUMMARY

The present invention includes a shield and a fastener. The fastener holds the shield in place, forming a closed conductive surface. As shown in FIG. 13, the fastener has hooks for catching and holding the mesh fibers of the shield. In one variation, the shield winds around the cable bundle and the fastener holds the overlapping portions of the shield together. Many winding methods may be used, varying, for instance, with the diameter of the cable bundle. Moreover, this cable sheath is easy to install even after the cables have been laid.

DESCRIPTION

Figure 1:
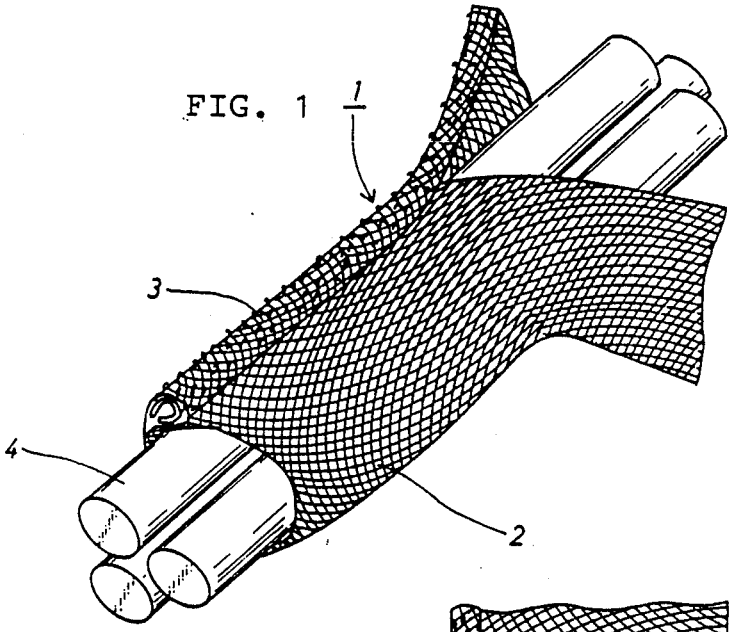
FIG. 1 is a perspective view of a first embodiment.
Figure 2A:
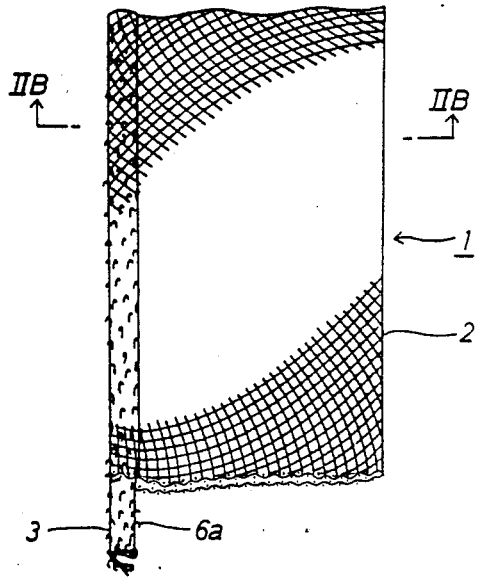
FIG. 2A shows one variation of the first embodiment with a fastener inserted inside the shield.
Figure 2B:
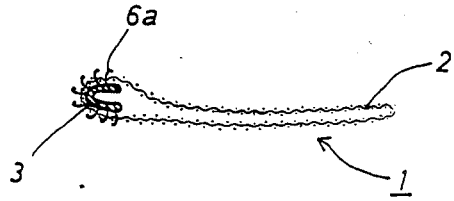
FIG. 2B is a sectional view of the first variation on the first embodiment taken along line IIB-IIB in FIG. 2A.

A first embodiment is shown in FIG. 1. A tubular shield 2 made of conductive-wire mesh is wrapped around a cable 4 bundle, and is secured by fastener 3 with hooks 6*a*. FIG. 2A shows an unrolled segment of the cable sheath 1. The fastener 3 is inserted into the sleeve-like shield 2 and is pressed against one side so the hooks 6*a* protrude, as indicated in FIG. 2B. Thus prepared, the sheath 1 may be wrapped around a cable 4 bundle, as shown in FIG. 1. The hooks 6*a* of the fastener 3 hold the ends of the shield 2 together forming a closed conductive surface.

Figure 3A:
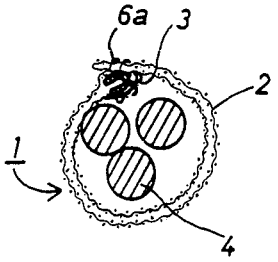
FIGS. 3A through 3E are sectional views of several more variations on the first embodiment.
Figure 3E:
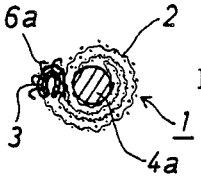
Figure 3B:
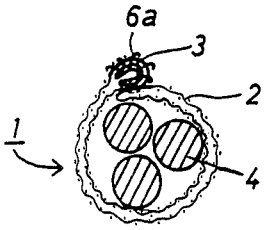
Figure 3C:
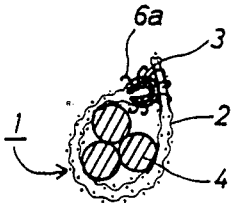
Figure 3D:
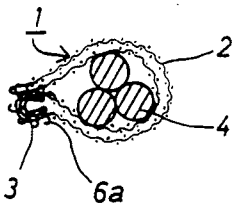
Figure 4:
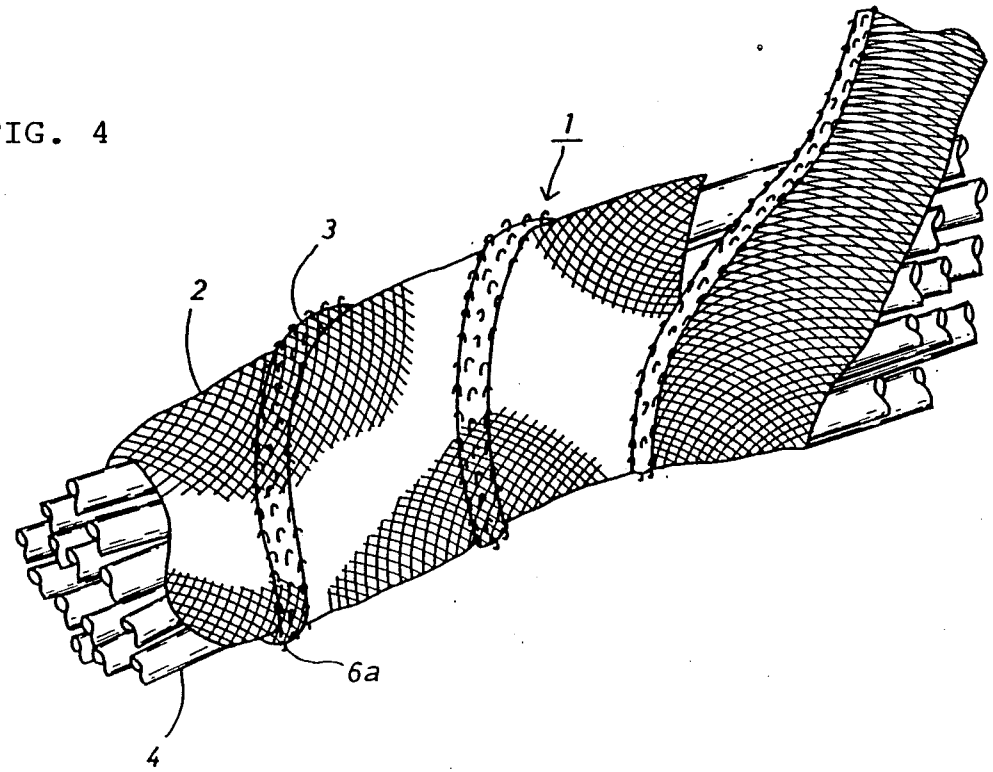
FIG. 4 is a perspective view of another variation on the first embodiment.
Figure 6A:
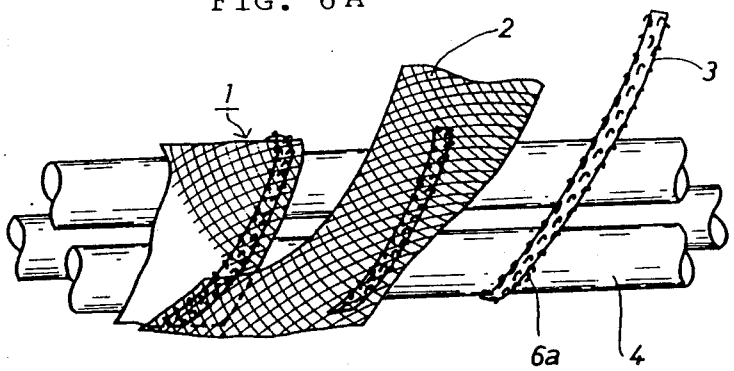
FIGS. 6A and 6B are perspective views of two more variations on the first embodiment.
Figure 6B:
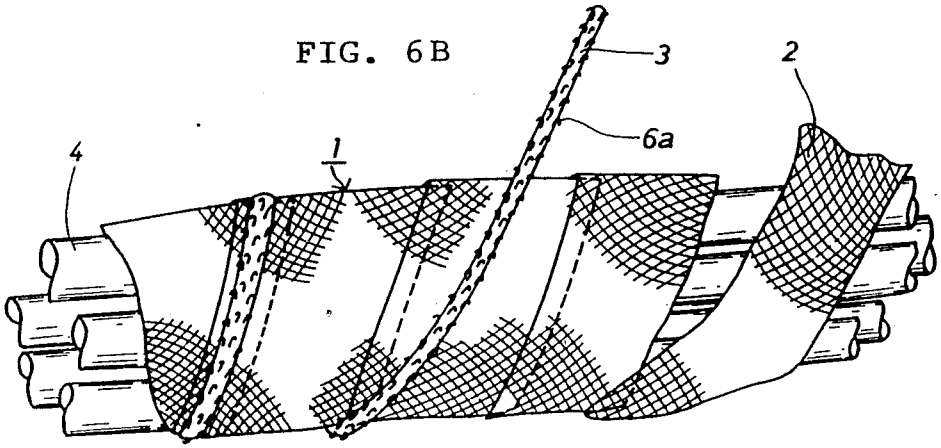
Figure 5B:
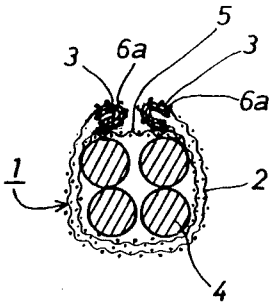
FIGS. 5A and 5B are sectional views of two more variations on the first embodiment.
Figure 5A:
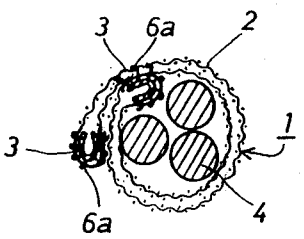

The cable sheath 1 can be used many ways, some of which are shown in FIGS. 3A through 4. In FIG. 4, the cable sheath 1 is spirally wound around a cable 4 bundle where the circumference of the bundle exceeds the width of the cable sheath 1. FIGS. 5A through 6B show some variations on the basic cable sheath 1. A fastener 3 is used at each end of the shield 2 in FIGS. 5A and 5B. An additional piece 5 of shield 2 is used, in FIG. 5B, to bridge the gap because the cable 4 bundle circumference exceeds the cable sheath 1 width. The variations in FIGS. 6A and 6B are similar to the one in FIG. 4 except that the fastener 3 is not inserted into the shield 2, but is wound separately. In FIG. 6A the fastener 3 is under the shield 2; in FIG. 6B the shield 2 is under the fastener 3.

Figure 7A:
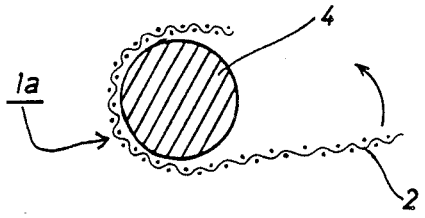
FIGS. 7A through 7C are sectional views of a second embodiment during installation.
Figure 7B:
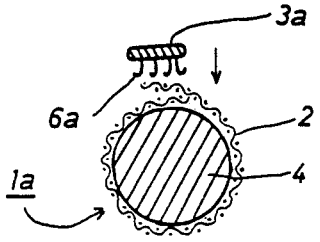
Figure 7C:
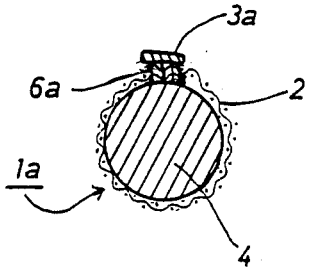
Figure 8A:
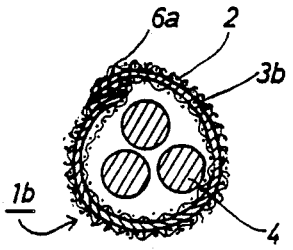
FIG. 8A is a sectional view of a third embodiment.
Figure 8B:
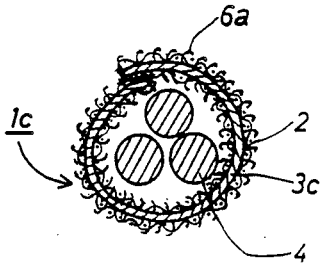
FIG. 8B is a sectional view of a fourth embodiment.

A second embodiment of the cable sheath 1*a*, shown in FIGS. 7A and 7B uses a flat, single-sided fastener 3*a*. In a third embodiment of the cable sheath 1*b*, shown in FIG. 8A, the fastener 3*b* spreads throughout the shield 2. A fourth embodiment cable sheath 1*c*, shown in FIG. 8B, is like the third embodiment cable sheath 1*b* except the hooks 6*a* protrude from both sides of the fastener 3*c*.

Figure 9:
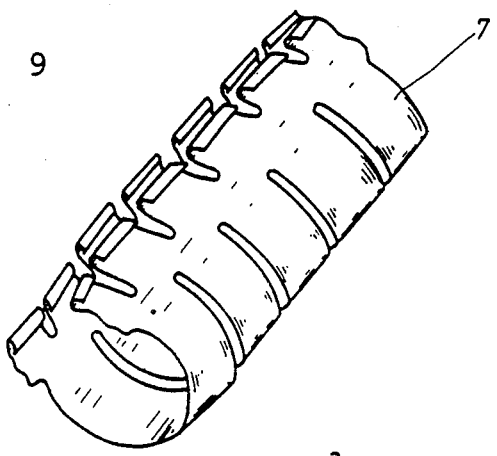
FIG. 9 is a perspective view of a guard used in a fifth embodiment.
Figure 10:
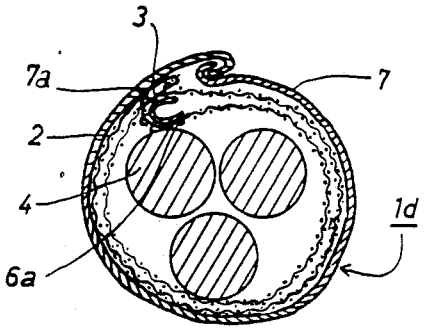
FIG. 10 is a sectional view of the fifth embodiment.

A fifth embodiment of the cable sheath 1*d*, shown in FIG. 10, uses the flexible guard 7 shown separately in FIG. 9. A cable sheath 1, for instance the first embodiment cable sheath 1, is attached inside the guard 7 at a connection site 7*a*. The connection site 7*a* is located close to the opening of the guard 7 so the cable sheath 1 wraps around the cable 4 bundle when the guard 7 is installed.

Figure 11:
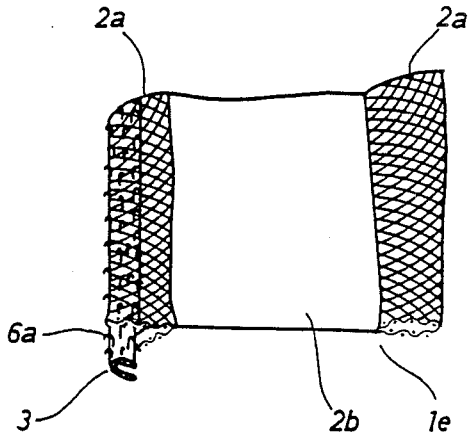
FIG. 11 is a perspective view of a sixth embodiment.

The shield 2 need not be entirely mesh. A sixth embodiment of the cable sheath 1*e*, shown in FIG. 11, has conductive mesh tubes 2*a* at both sides of a conductive sheet 2*b*. The fastener 3 may be inserted into either tube 2*a*. The resulting cable sheath 1*e* may be used as the other embodiments are used.

Figure 12:
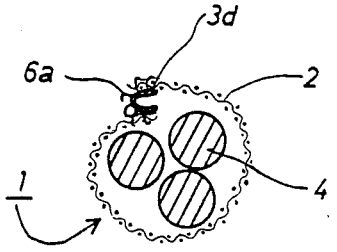
FIG. 12 is a sectional view of the first embodiment using a conductive fastener.

If the fastener 3 and its hooks 6*a* are conductive, they form part of the closed conductive surface, thus improving the overall conductivity of the closed surface. FIG. 12 shows the first embodiment cable sheath 1 taking advantage of a conductive fastener 3*d*.

Figure 13:
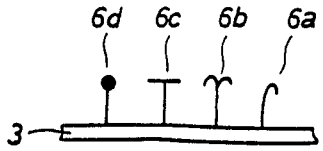
FIG. 13 shows some hook designs.
Figure 14:
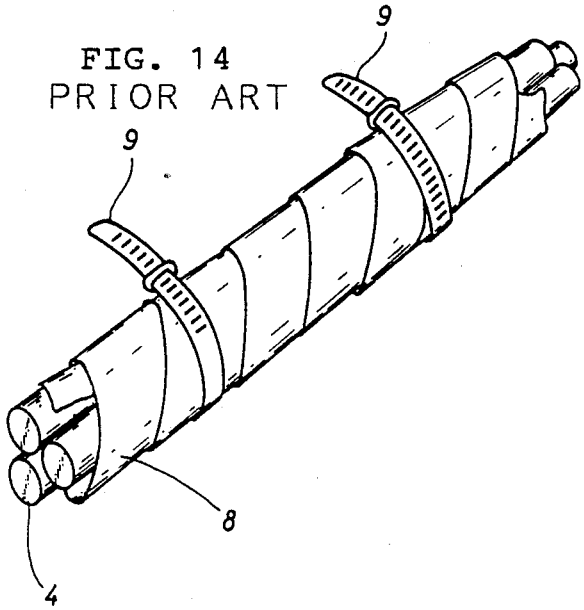
FIG. 14 PRIOR ART
FIG. 14 is a perspective view of a prior-art cable sheath.

Although this description has focused on a simple hook 6*a*, many different hook designs may be used for the fastener 3. Four designs are shown in FIG. 13: a simple hook 6*a*, a double hook 6*b*, a T-hook 6*c*, and a knob hook 6*d*. *Other designs could be used as well. The preceding description also focuses on the use of conductive mesh; however, other conductive materials, e.g., steel wool or expanded metal, could be used for the shield 2 as long as they can be securely retained by the hooks 6a* of the fastener 3.

This description merely describes some embodiments of the claims without exhausting all of the possible variations; the scope of this invention is limited only by the following claims.

I claim:

1. A cable sheath for forming a conductive surface around a cable comprising a shielding strip comprising hookable, conductive material, and at least one fastener comprising a base and hook-like protrusions, wherein the hook-like protrusions are capable of hooking into and retaining the shielding strip securely in position around a cable.

2. A cable sheath, as in claim 1, where the fastener is conductive.

3. A cable sheath, as in claim 1, where the cable sheat is concentrically fixed within a cable guard for simultaneous installation.

4. A cable sheath, as in claim 1, wherein the shielding strip is tubular so the fastener may be placed inside the shielding strip with the hook-like protrusion protruding through the shielding strip for simultaneous installation of both the fastening means and the shielding strip.

* * * * *